US008371722B2

(12) United States Patent
Carroll

(10) Patent No.: US 8,371,722 B2
(45) Date of Patent: Feb. 12, 2013

(54) LED-BASED LIGHT BULB DEVICE WITH KELVIN CORRECTIVE FEATURES

(75) Inventor: David W. Carroll, Grantsburg, WI (US)

(73) Assignee: Forever Bulb, LLC, Grantsburg, WI (US)

( * ) Notice: Subject to any disclaimer, the term of this patent is extended or adjusted under 35 U.S.C. 154(b) by 226 days.

(21) Appl. No.: 12/939,587

(22) Filed: Nov. 4, 2010

(65) Prior Publication Data

US 2011/0103055 A1 May 5, 2011

Related U.S. Application Data

(60) Provisional application No. 61/258,090, filed on Nov. 4, 2009.

(51) Int. Cl.
*F21V 3/00* (2006.01)

(52) U.S. Cl. ..... 362/311.02; 362/235; 362/246; 362/355

(58) Field of Classification Search ..... 362/311.02, 362/249.02, 235, 236, 240, 242, 244, 246, 362/255, 363, 267, 355
See application file for complete search history.

(56) References Cited

U.S. PATENT DOCUMENTS

| | | | | |
|---|---|---|---|---|
| 6,367,949 | B1 | 4/2002 | Pederson | |
| 6,739,734 | B1 | 5/2004 | Hulgan | |
| 6,964,498 | B2 * | 11/2005 | Wu | 362/242 |
| 7,086,756 | B2 | 8/2006 | Maxik | |
| D529,202 | S | 9/2006 | Nagai et al. | |
| 7,217,956 | B2 | 5/2007 | Daniels et al. | |
| 7,259,030 | B2 | 8/2007 | Daniels et al. | |
| 7,318,661 | B2 | 1/2008 | Catalano | |
| D581,066 | S | 11/2008 | Van Dyn Hoven | |
| 7,588,351 | B2 | 9/2009 | Meyer | |
| 2002/0021573 | A1 | 2/2002 | Zhang | |
| 2002/0176253 | A1 | 11/2002 | Lee | |
| 2003/0031015 | A1 | 2/2003 | Ishibashi | |
| 2003/0174499 | A1 | 9/2003 | Bohlander | |
| 2005/0030761 | A1 | 2/2005 | Burgess et al. | |
| 2005/0174769 | A1 | 8/2005 | Yong et al. | |

(Continued)

FOREIGN PATENT DOCUMENTS

| | | | |
|---|---|---|---|
| DE | 10 2007 056 874 | A1 | 5/2009 |
| JP | 2005-310561 | A | 11/2005 |

(Continued)

OTHER PUBLICATIONS

PCT Search Report (mailed Feb. 11, 2011); 14 pgs.

*Primary Examiner* — Robert May
(74) *Attorney, Agent, or Firm* — Dicke, Billig, Czaja, PLLC

(57) ABSTRACT

An LED light bulb device including a bulb body, a cap, an LED assembly, and first and second light affecting features. The cap is mounted to the bulb body for connection to an electrical socket. The LED assembly includes a plurality of LEDs and framework. The framework maintains the LEDs relative to the bulb body such that emitted light is directed at an LED region of the wall. The first light affecting feature is associated with the LED region of the wall, whereas the second light affecting feature is associated with a diffusion region of the wall, with the diffusion region being apart from the LED region. The first light affecting feature affects light in a manner different from that of the second light affecting feature. The light affecting features are selected to affect or alter light emitted from the LEDs to provide a desired Kelvin color temperature and diffusion.

14 Claims, 8 Drawing Sheets

U.S. PATENT DOCUMENTS

| | | | |
|---|---|---|---|
| 2006/0012997 | A1 | 1/2006 | Catalano et al. |
| 2006/0221606 | A1 | 10/2006 | Dowling |
| 2006/0285325 | A1 | 12/2006 | Ducharme et al. |
| 2006/0291256 | A1 | 12/2006 | Cobbler |
| 2007/0103914 | A1 | 5/2007 | McCaffrey |
| 2007/0291482 | A1 | 12/2007 | Baroky et al. |
| 2008/0024070 | A1 | 1/2008 | Catalano et al. |
| 2008/0285279 | A1 | 11/2008 | Ng et al. |
| 2009/0033245 | A1 | 2/2009 | Tsai et al. |
| 2009/0086492 | A1 | 4/2009 | Meyer |
| 2009/0302730 | A1 | 12/2009 | Carroll et al. |
| 2010/0301353 | A1 | 12/2010 | Pabst et al. |

FOREIGN PATENT DOCUMENTS

| | | | |
|---|---|---|---|
| JP | 20053110561 | A2 | 11/2005 |
| WO | 2005/090852 | A2 | 3/2005 |
| WO | 2005/090852 | A2 | 9/2005 |
| WO | 2009/149263 | A1 | 6/2009 |
| WO | 2009/149263 | | 12/2009 |

* cited by examiner

LED-BASED LIGHT BULB DEVICE WITH KELVIN CORRECTIVE FEATURES

CROSS-REFERENCE TO RELATED APPLICATIONS

This application claims priority under 35 U.S.C. §119(e)(1) to U.S. Provisional Patent Application Ser. No. 61/258,090, filed Nov. 4, 2009, entitled "LED-Based Light Bulb Device with Kelvin Corrective Features"; and the entire teachings of which are incorporated herein by reference.

BACKGROUND

The present disclosure relates to light emitting diode (LED) illuminating devices and methods, and more particularly to LED-based lighting solutions in a format akin to a common incandescent light bulb.

Incandescent light bulb replacement solution, such as compact fluorescent lights (CFLs) and LED bulbs, are becoming more widely used as the cost of energy increases. Unfortunately, aesthetic concerns exist for the "tubes" of the CFL format and unusual shapes of current LED environmental solutions. Consumers as commercial concerns have pre-existing fixtures or sockets that in many cases look unappealing with these new replacement bulb offerings. In many cases, consumers avoid doing what is environmentally and financially correct to maintain the aesthetical look of the long-lived shape and look of the common incandescent bulb.

LED-based lights provide the longest lasting, and over time the lowest cost and the most environmentally friendly, solution for lighting. However, a major problem is the initial high-cost per lumen and the directional nature of the light dispersion method. Any efforts to resolve these concerns will be well-received. Consumer expect a "soft" or "warm" light as found with conventional incandescent light bulbs; LED lights are either too bright or intense, or if placed within a Kelvin color temperature corrective enclosure (e.g., a white "frosted" glass enclosure), cannot generate sufficient lumens and/or require inordinate power.

SUMMARY

Some aspects in accordance with principles of the present disclosure relate to an LED light bulb device including a bulb body, a cap, an LED assembly, a first light affecting feature, and a second light affecting feature. The bulb body has a wall defining an exterior surface, an interior surface, and an open interior. The cap is mounted to the bulb body and forms a surface for selective connection to an electrical socket. The cap and the bulb body combine to define a light bulb-like structure. The LED assembly includes a plurality of LEDs and framework. The framework maintains the LEDs relative to the bulb body such that emitted light is directed at an LED region of the wall. The first light affecting feature is associated with the LED region of the wall, whereas the second light affecting feature is associated with a diffusion region of the wall, with the diffusion region being apart from, or separate from, the LED region. Finally, the first light affecting feature affects light in a manner different from that of the second light affecting feature. With this construction, the light affecting features are selected to affect or alter light emitted from the LEDs to provide a desired Kelvin color temperature. In some embodiments, the first light affecting feature is a coating, film, fabric, or surface texturing applied to or formed along the bulb body only in a region at which the LEDs are directly facing. The second light affecting feature can be a "conventional" white coating applied to the bulb body, or alternatively is simply the absence of the first light affecting feature. Regardless, with constructions in which the LEDs are disposed along an exterior surface of the bulb body, light emitted from the LEDs is first directed inwardly to the bulb body wall via the first light affecting structure, and into the interior; consistent with light wave properties, the so-directed light is then directed outward from the interior and through the bulb body wall via the second light affecting feature to illuminate the exterior environment surrounding the LED light device. Effectively, then, light from the LEDs can be subjected to a double diffusion and/or coloring process (via the first and second light affecting features), thereby "softening," "warming," and/or "broadening" the light ultimately delivered to the surrounding environment.

DETAILED DESCRIPTION

Figure 1:
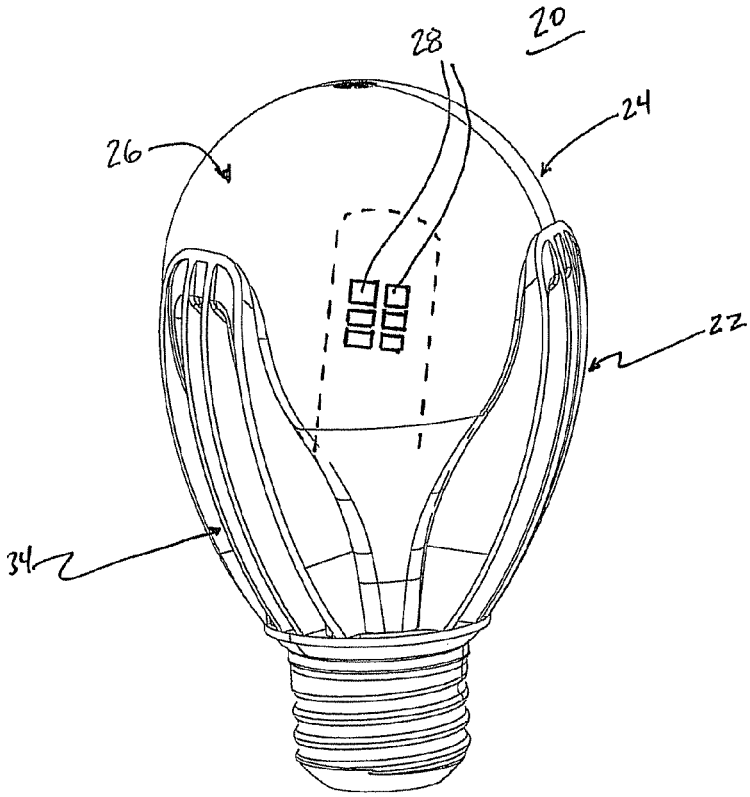
FIG. 1 is a perspective view of a LED light bulb device in accordance with principles of the present disclosure, including a representation of LEDs otherwise hidden in the view.

One embodiment of an LED light bulb device 20 in accordance with aspects of the present disclosure is shown in FIG. 1. The device 20 includes an LED assembly 22 (referenced generally) and a light bulb-like structure 24. Details on the various components are provided below. In general terms, however, the light bulb-like structure 24 includes a bulb body 26, and the LED assembly 22 provides one or more light emitting diode lights (LEDs) 28 (several of which are illustrated generally in FIG. 1 as being visible "through" the bulb body 26 for ease of explanation). The LED assembly 22 is mounted to the light bulb-like structure 24, with the resultant LED light bulb device 20 emitting light when connected to, and energized by, a standard light bulb socket. In this regard, a light affecting feature (hidden in FIG. 1) is associated with the bulb body 26 in a region immediately proximate the LED 28, and desirably affects or alters light emitted from the LED 28 in a manner differing from other regions of the bulb body 26 to provide desired Kelvin color temperature. In some constructions, the LED assembly 22 and/or the light bulb-like structure 24 can take any of the forms described in U.S. application Ser. No. 12/535,893 filed Jul. 20, 2009 and entitled "LED-Based Light Bulb Device"; the entire teachings of which are incorporated herein by reference.

Figure 2:
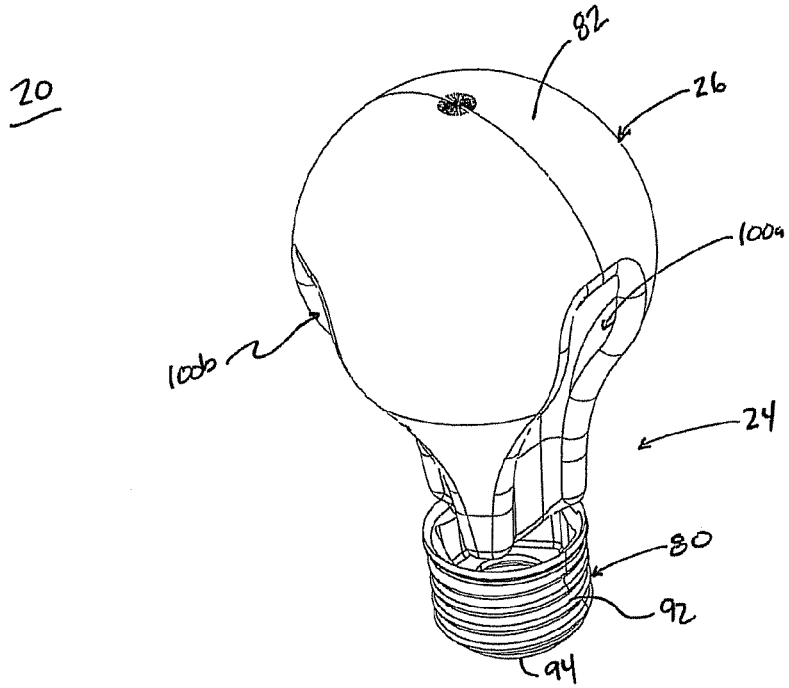
FIG. 2 is a perspective, exploded view of the LED light bulb device of FIG. 1.
Figure 2:
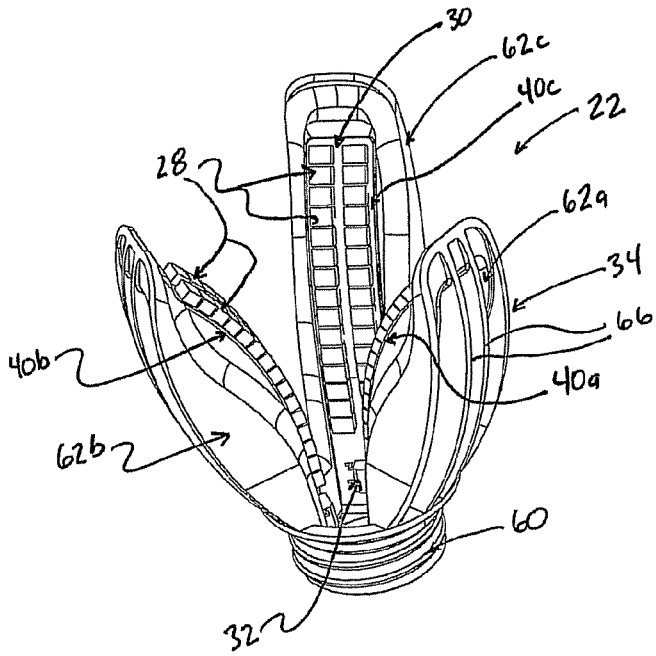

With reference to FIG. 2, the LED assembly 22 includes, in some embodiments, a plurality of the LEDs 28, a substrate 30, circuitry 32 (referenced generally), and framework 34 that can optionally serve as a heat sink body. The substrate 30 optionally maintains the LEDs 28 and the circuitry 32 in a manner facilitating desired arrangement of the components 28, 32 relative to the light bulb-like structure 24, as well as establishing an electrical pathway for powering of the LEDs 28. The framework 34 robustly mounts the LED assembly 22 to the light bulb-like structure 24 and optionally serves to dissipate heat from the LEDs 28 and the circuitry 32.

Figure 3:
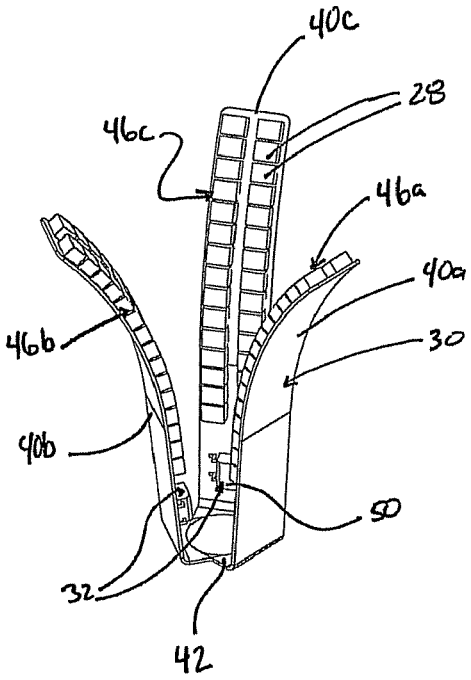
FIG. 3 is a perspective of a portion of an LED assembly component of the device of FIG. 1.

In some constructions and with additional reference to FIG. 3, the substrate 30 is a flexible, non-conductive material and combines with the circuitry 32 to form a flex circuit as known in the art. Alternatively, a more rigid material can be employed for some or all of the substrate 30 (e.g., the LEDs 28 can be maintained by a flexible substrate, whereas portions or all of the circuitry 32 are formed as part of a rigid, printed circuit board). Regardless, the circuitry 32 includes conductive circuitry electrically interconnecting the LEDs 28 with power transformer circuitry. As best shown in FIG. 3, the substrate 30 can form a plurality of legs 40 extending from a base 42. Alternatively, in a wide variety of other constructions for the substrate 30 are equally acceptable. With the but one acceptable configuration of FIGS. 2 and 3, however, each of the legs 40 maintains a discrete set 46 of LEDs 28, with the LEDs 28 of each set 46 being located in close or spaced proximity to one another (relative to the corresponding leg 40) along a major surface of the substrate 30. For example, the first leg 40*a* maintains the first set 46*a* of LEDs 28, the second leg 40*b* maintains the second set 46*b* of LEDs 28, etc. While three of the legs 40 are depicted, any other number, greater or lesser, is also acceptable.

The circuitry 32 can assume a wide variety of forms appropriate for converting AC energy (e.g., 120 volts) to DC energy appropriate for energizing the LEDs 28; or where the LEDs 28 are configured to operate based on an AC power input, the circuitry 32 can incorporate components configured to transform a provided AC power supply to an AC power format appropriate for powering the LEDs 28. For example, in some embodiments, the circuitry 32 incorporates power transformer circuitry 50 (referenced generally) including a line voltage input terminal pad, a line voltage return terminal pad, a resistor, a current controller, and a bridge rectifier. While the resistor, the current controller, and/or the bridge rectifier (or other power transforming chip set) can be encapsulated by the substrate 30, the terminal pads are exteriorly exposed, and thus available for electrically interfacing with a source of AC power, such as a standard AC light socket.

Figure 4A:
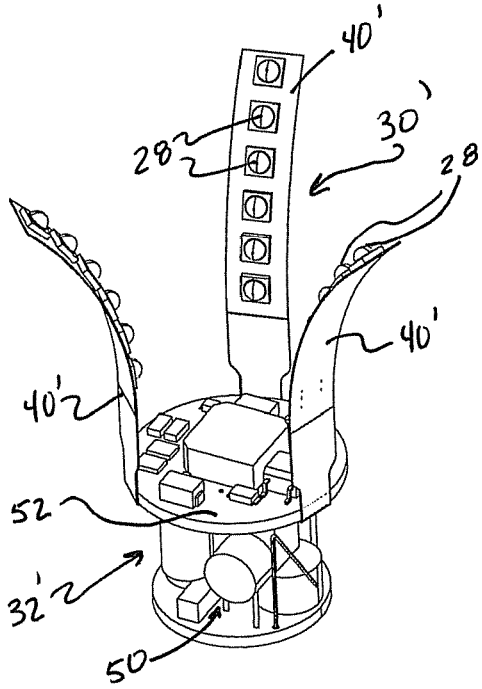
FIG. 4A is an exploded perspective view of components of another LED light bulb device in accordance with principles of the present disclosure.
Figure 4A:
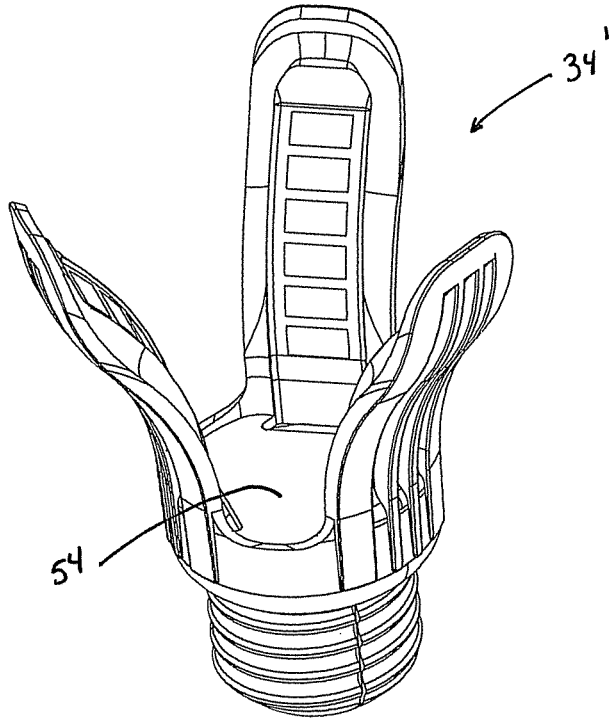
Figure 4B:
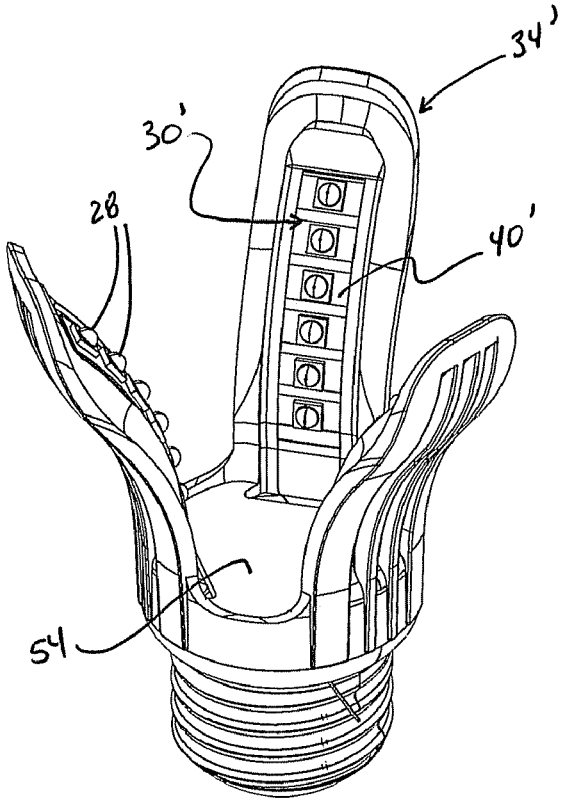
FIG. 4B is a perspective view of the components of FIG. 4A upon final assembly.

FIG. 4A illustrates an alternative construction substrate 30' and circuitry 32' exploded from an alternative framework 34' in accordance with the present disclosure. The substrate 30' is formed as a plurality of individual or discrete legs 40' each maintaining a set of the LEDs 28. The discrete legs 40' are mounted to a platform 52 that otherwise forms and maintains various components of the circuitry 32', such as power transformer circuitry 50' (referenced generally). The platform 52 can be a rigid printed circuitry board having or forming necessary circuitry traces. Upon final assembly to the framework 34' (shown in FIG. 4B), a base wall 54 of the framework 34' covers the platform 52 (FIG. 4A) and any circuitry 50' (FIG. 4A) mounted thereto. When applied to the bulb body 26 (FIG. 1), then, the base wall 54 physically separates the circuitry 32' from a user were the bulb body 26 to break.

Returning to FIGS. 2 and 3, the LEDs 28 can assume a variety of forms known in the art and conventionally employed for inorganic light-emitting diodes. The LEDs 28 can alternatively be organic light-emitting diodes (OLEDs). The selected format of the LEDs 28 may or may not produce white light, and can have various color temperatures (e.g., the LEDs 28 can be high temperature (on the order of 6500 Kelvin) products). Further, the packaging associated with the LEDs 28 may or may not incorporate color or Kelvin modifying materials such as phosphor, quantum dots, nanocrystals and/or other coatings or layers for enhancing the light emitted by the LEDs 28. The LEDs 28 can be formed or assembled to the substrate 30 in various fashions, including standard packaging, die-on-flex packaging, wafer-layering with sputter coating that permits, for example, non-sapphire based LEDs, etc.

Returning to FIG. 2, the framework 34 is configured to support the legs 40 (and thus the corresponding LEDs 28) relative to the bulb body 26. In some constructions, the framework 34 further serves as a heat sink, dissipating heat generated by the components 28 and/or 32, and thus is formed of an appropriate heat sink material (e.g., molded plastic, ceramic, metal, etc.). With this in mind, in some embodiments, the framework 34 includes or forms a hub 60 and a plurality of stems 62. In general terms, the hub 60 is formed in accordance with the size and shape of a corresponding component of the light bulb-like structure 24 as described below, and encircles the base 42 of the substrate 30. The stems 62 extend from the hub 60, and are sized and shaped in accordance with respective ones of the legs 40. Thus, the number of stems 62 corresponds with the number of legs 40, and vice-versa. As shown in FIG. 2, then, the first stem 62*a* corresponds with the first leg 40*a*, the second stem 62*b* corresponds with the second leg 40*b*, etc. In some constructions, the stems 62 have a length greater than a length of the corresponding legs 40 to more fully encompass the legs 40. Optionally, fins 66 are formed along each of the stems 62 to further promote heat dissipation. Alternatively, the framework 34 can have other features not shown (for example, the framework 34' of FIGS. 4A and 4B).

The LED assembly 22 can be employed with a variety of different light bulb-like structures 24. In general terms, however, the light bulb-like structure 24 is akin to a "standard" or known AC bulb (e.g., an Edison light bulb) and includes the bulb body 26 and a cap 80. The bulb body 26 can be formed of glass, plastic (e.g., clear glass or plastic), etc., and includes a wall 82 defining an enclosed space. The bulb body 26 can have various shapes and sizes (e.g., pear shape (A-19), rounded globe, pyramidal (flood light), candle-shape, etc.) as well as other optional features described below that promote a more streamlined appearance of the mounted LED assembly 22. The cap 80 is affixed to the bulb body 26, and can form a threaded exterior surface 90 for threadably engaging a standard AC light socket in selectively mounting the LED light device 20 to the AC light socket as is known it the art. Along these same lines, the cap 80 is optionally formed of a conductive material (e.g., metal) as is typically employed with conventional light bulbs, and forms a positive contact surface 92 that is electrically isolated from a neutral contact surface 94 (referenced generally).

Figure 5:
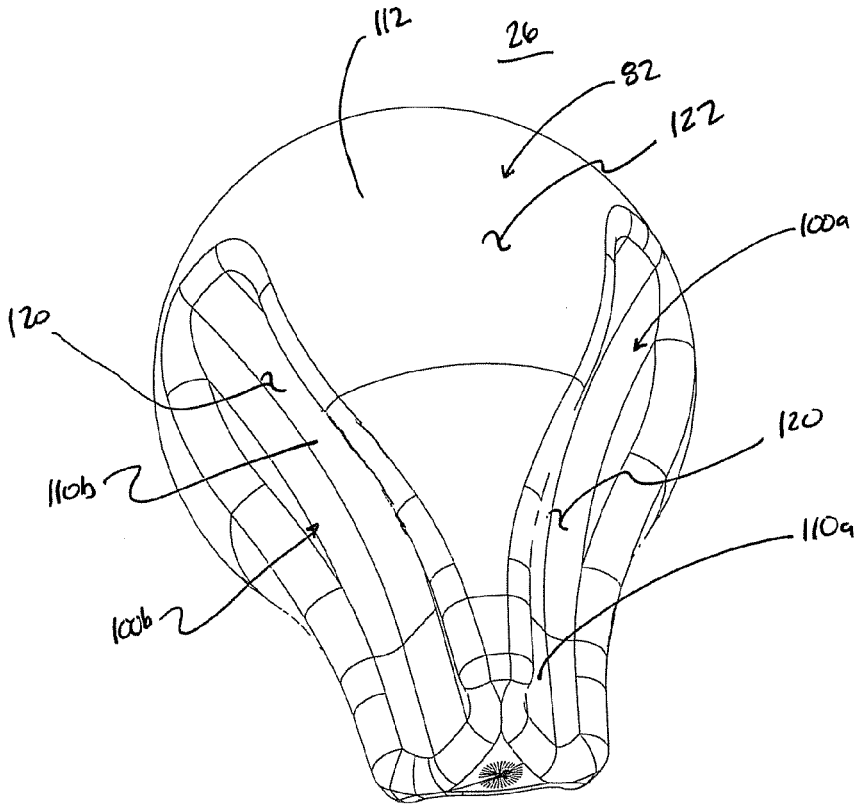
FIG. 5 is an enlarged, perspective view of a bulb body portion of the LED light bulb device of FIG. 1.

The bulb body 26 can, in some constructions, form or define recesses 100 sized in accordance with respective ones of the stems 62 and the corresponding legs 40/LEDs 28. For example, and with additional reference to FIG. 5, a first recess or trough 100*a* is sized and shaped to receive the first stem 62*a* and the corresponding first leg 40*a* and first set 46*a* of LEDs 28; a second recess or trough 100*b* is sized and shaped to receive the second stem 62*b* and the corresponding second leg 40*b* and second set 46*b* of LEDs 28; etc. Alternatively, the bulb body 26 can have a more continuous shape along the wall 82 (i.e., the recesses 100 can be eliminated) and/or other surface curvatures, indentations, protrusions, etc., can be provided.

Regardless of an exact shape of the wall 82, different light affecting features are associated with the bulb body 26. For example, and as identified in FIG. 5, the bulb body 26 can be characterized as generally defining one or more LED regions 110 and a diffusion region 112. The LED regions 110 represent the location(s) of the bulb body 26 at which the LEDs 28 (FIG. 2) are immediately proximate (and "aiming" at) upon final assembly, whereas the diffusion region 112 represents a surface area of the bulb body 26 apart from the LED region(s) 110. Thus, with the one embodiment of FIG. 4, the LED regions 110 correspond with the recesses 100, and the diffusion region 112 is apart from the recesses 100. Regardless, a first light affecting feature 120 (referenced generally) is associated with the LED regions 110, and a second light affecting feature 122 (referenced generally) is associated with the diffusion region 112. The light affecting features 120, 122 can assume various forms, such as films, coatings, fabrics, surface texturings, etc.; or the absence of films, coatings, fabrics, or surface texturings. In more general terms, the selected format of the first light affecting feature 120 alters light in a manner differing from that of the second light affecting feature 122, with the first light affecting feature 120 optionally being selected to cause a Kelvin-warming alteration of light emitted directly from the LEDs 28 (FIG. 2) onto the first light affecting feature 120, and the second light affecting feature 122 optionally being selected to diffuse light emitted from the bulb body 26. In yet other constructions, the first light affecting feature 120 can also diffuse light.

Figure 6A:
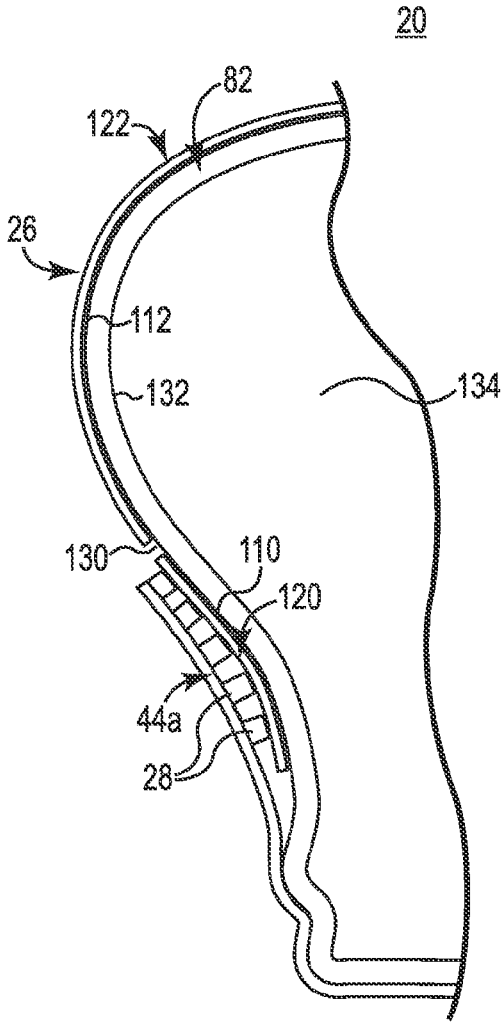
FIGS. 6A and 6B are simplified, cross-sectional views of a portion of the LED light bulb device of FIG. 1, illustrating various arrangements of a light affecting feature.

In some embodiments, the first light affecting feature 120 represents a modification of the optical/color properties otherwise associated with the wall 82; the second light affecting feature 122 can also modify the optical/coloring characteristics of the wall 82, or can simply be characterized by the absence of any modification. With this understanding in mind, FIG. 6A is a simplified cross-sectional view of a portion of the LED light bulb device 20 incorporating one embodiment of the first light affecting feature 120. As a point of reference, the view of FIG. 6A illustrates the wall 82 as defining an exterior surface 130, an interior surface 132, and an interior region 134 defined (e.g., enclosed) by the bulb body 26. With these definitions in mind, the first light affecting feature 120 is applied to the exterior surface 130 immediately adjacent the first set 44*a* of LEDs 28 (it being recalled that the location when assembled to the first set 44*a* of LEDs 28 effectively creates or defines one of the LED regions 110 of the bulb body 26). The first light affecting feature 120 can be a color corrective coating(s), film(s), and/or fabric(s) applied to the exterior surface 130 at the LED region 110 (i.e., the first light affecting feature 120 does not extend to the diffusion region 112). In addition, the coating, film, or fabric can be coated with other materials, or a blend of materials, such as a blend of variously sized crystals: large ones made of phosphorous and nanocrystals made of semiconductor materials such as cadmium selenide and indium phosphide. The coating, film, or fabric of the first light affecting feature 120 is a Kelvin-modified material selected to provide increased brightness and/or warmth to light emitted from the LEDs 28. For example, the coating, film, or fabric can contain nano structures or elements affecting the warmth of light emitted from an LED. The first light affecting feature 120 serves to enhance, diffuse, and/or change the color of the light emitted from the LEDs 28. In some embodiments, then, the LEDs 28 can be intense LEDs (e.g., a 6500 Kelvin product), with the first light affecting feature 120 enhancing the light color delivered through/from the wall 82 via a color warming process. Along these same lines, by providing the first light affecting feature 120 with the bulb body 26, the need to include corrective coloring with the LED package itself can be greatly reduced and even eliminated. In other embodiments, however, the color corrective coating(s), film(s) or fabric(s) of the first light affecting feature 120 are applied to the substrate 30 (FIG. 3) prior to assembly with the light bulb-like structure 24 (e.g., the LED assembly 22 is a die-on-flex structure).

In addition, or as alternative, to the coatings, films, and/or fabrics, the first light affecting feature 120 can be or include a texturing of the exterior surface 130 and/or the interior surface 132 at the LED region 110 to enhance light diffusion. For example, the wall 82 can be etched along the LED region portion 110 or otherwise molded in a light refraction pattern. For example, a fractal pattern can be molded to the exterior surface 130 at the LED region 110.

Figure 6B:
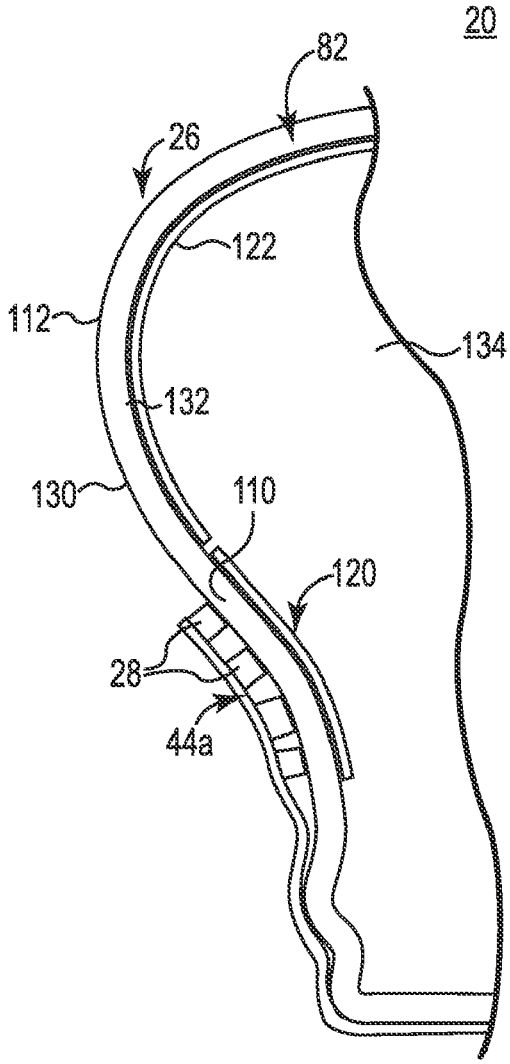

FIG. 6B illustrates an alternative configuration of the first light affecting feature 120. In particular, with the embodiment of FIG. 6B, the light affecting feature 120 is akin to any of the formats described above, but is applied to the interior surface 132 of the wall 82. Once again, however, the first light affecting feature 120 is provided at the LED region 110 of the bulb body 26 and thus immediately proximate the LEDs 28 associated with the LED region 110 of the bulb body 26, such that light from the LEDs 28 is directly "aimed" at the first light affecting feature 120.

In yet other embodiments, the first light affecting feature 120 is embedded within a thickness of the wall 82 at the LED region(s) 110 (e.g., colored glass or plastic).

While the first light affecting feature 120 has been described as essentially covering an entirety of a face of the corresponding recess 100, in other embodiments, less coverage is provided. For example, the LEDs 28 can be arranged along the corresponding leg 40 in a more spaced apart manner as compared to the relatively close packaging reflected in FIG. 3 (for example as shown in FIG. 4A). The bulb body 26, in turn, can form the LED region 110 of the recess 100 (otherwise configured to receive the corresponding leg 40) as a series of discrete dimples or inward projections, each sized to receive a respective one of the LEDs 28. With this optional construction, the first light affecting feature 120 can be applied only at the dimples (and not necessarily an entirety of the LED region 110). The first light affecting feature 120 generates directionality in the light emitting from the LED 28 and is not required to cover an entirety of the recess 100.

Regardless of how and where the first light affecting feature 120 is associated with the bulb body 26, with embodiments in which the framework 34 is assembled over the exterior surface 130 of the wall 82, the surface area "coverage" of the first light affecting feature 120 is the same as, or less than, the surface area of the corresponding framework 34 portion as generally reflected in FIG. 1. For example, and with additional reference to FIGS. 2 and 6A, with respect to the first LED region 110*a* associated with the first recess 100*a*, a location of the first light affecting feature 120 corresponds with a location of the first stem 62*a*, and encompasses an area of the wall 82 that is less than or equal to an area of the wall 82 that is encompassed by the first stem 62*a*. Thus, upon final assembly, the first stem 62*a* covers the first light affecting feature 120 applied at the first LED region 110*a*. As a result, a viewer of the LED light bulb device 20 cannot visually perceive or "see" the first light affecting feature 120 from an exterior of the LED light bulb device 20.

As indicated above and returning to FIGS. 5-6B, the second light affecting feature 122 is, in some respects, akin to the first light affecting feature 120, and thus can include light affecting coatings, films, or fabrics. Regardless, the second light affecting feature 122 is different from the first light affecting feature 120, and typically provides desired light diffusion properties. For example, the second light affecting feature 122 can be a "conventional" white coating or alumina applied to the bulb body 26 (e.g., the exterior surface 130 or the interior surface 132) in all exposed areas (i.e., the diffusion region 112) except where the LEDs 28 are disposed. In these LED regions 110, the first light affecting feature 120 is provided. In yet other embodiments, the second light affecting feature 122 is applied to an entirety of the bulb body 26 (e.g., the exterior surface 130 or the interior surface 132), whereas the first light affecting feature is applied only at the LED regions 110.

As with the first light affecting feature 120 embodiments of the FIGS. 6A and 6B, the second light affecting feature 122 can be applied or formed on the exterior surface 130 (as in FIG. 6A), the interior surface 132 (as in FIG. 6B) or embedded within a thickness of the wall 82. In other embodiments, the second light affecting feature 122 is the absence of any coating, film, or fabric applied to (or embedded within) the wall 82; instead, the diffusion properties inherent to the wall 82 material provide a desired effect on light in a manner differing from the first light affecting feature 120.

With the one embodiment of FIGS. 1 and 2 in which the LEDs 28 are disposed along the exterior surface 130 (FIG. 6A) of the bulb body 26, when powered, the LEDs 28 generate and emit light. In this regard, light emitted from the LEDs 28 is first directed inwardly through the bulb body wall 82 via the first light affecting structure 120, and into the interior region 134; consistent with light wave properties, the so-directed light is then directed outwardly from the interior region 134 and through the bulb body wall 82 via the second light affecting feature 122 to illuminate the exterior environment surrounding the LED light device 20. Effectively, then, light from the LEDs 28 is subjected to a double diffusion and/or coloring process (via the first and second light affecting features 120, 122), thereby "softening," "warming," and/or "broadening" the light ultimately delivered to the surrounding environment. This double diffusion effect can serve to lessen the likelihood that a user of the LED light device 20 will perceive the so-generated light as being too intense and/or too "cold", a concern that is common to prior LED-based lighting devices. Thus, for example, the first light affecting feature can be selected to generate a Kelvin warming effect onto the light direct emanating from the LEDs 28, whereas the second light affecting feature 122 provides desirable light diffusion so that the resultant light emitting from the LED light bulb device 20 is perceived as being highly similar to "soft" white light generated by conventional incandescent light bulbs. Further, when the LED light bulb device 20 is not powered, the first light affecting feature 120 is covered and a user only "sees" the second light affecting feature 122; with embodiments in which the second light affecting feature 122 is a white coating as typically applied to incandescent light bulbs, then, the LED light bulb device 20 will appear quite similar to a conventional light bulb. In other embodiments, the first light affecting feature 120 is applied to a bottom of the bulb body 26.

Although the present disclosure has been described with reference to preferred embodiments, workers skilled in the art will recognize that changes can be made in form and detail without departing from the spirit and scope of the present disclosure.

What is claimed is:

1. An LED light bulb device comprising:

a bulb body having a wall defining an exterior surface, an interior surface, and an open interior;

a cap mounted to the bulb body and forming a surface for selective connection to an electrical socket, the cap and bulb body combining to define a light bulb-like structure;

an LED assembly including a plurality of LEDs and framework maintaining the LEDs relative to the bulb body such that emitted light is directed at a first LED region of the wall;

a first light affecting feature associated with the first LED region of the wall;

a second light affecting feature associated with a diffusion region of the wall apart from the first LED region;

wherein the first light affecting feature affects light in a manner differing from that of the second light affecting feature;

wherein the plurality of LEDs include a first LED, the framework maintaining the first LED relative to the bulb body such that light emitted by the first LED is directed at the first light affecting feature; and wherein light from the first LED is directed inwardly into the open interior via the first light affecting feature and then outwardly from the open interior via the second light affecting feature.

2. The LED light bulb device of claim 1, wherein the first light affecting feature is selected from the group consisting of a coating, a film, a fabric, and a surface texturing.

3. The LED light bulb device of claim 2, wherein the first light affecting feature is applied to the exterior surface.

4. The LED light bulb device of claim 2, wherein the first light affecting feature is applied to the interior surface.

5. The LED light bulb device of claim 2, wherein the second light affecting feature is selected from the group consisting of a coating, a film, a fabric, and a surface texturing differing from the first light affecting feature.

6. The LED light bulb device of claim 2, wherein the second light affecting feature is characterized by the absence of a coating, a film, a fabric, and a surface texturing applied to the wall.

7. The LED light bulb device of claim 1, wherein the first light affecting feature is a coating exhibiting a first color and the second light affecting feature is a coating exhibiting a second, different color.

8. The LED light bulb device of claim 1, wherein the first LED is disposed along the exterior surface.

9. The LED light bulb device of claim 1, wherein the first LED is provided as part of a first set of LEDs, the plurality of LEDs further including a second set of LEDs, and further wherein the first set of LEDs is disposed against the wall at the first LED region, and the second set of LEDs is disposed against the wall at a second LED region of the wall, the first light affecting feature being associated with the second LED region.

10. The LED light bulb device of claim 9, wherein the framework includes a first stem maintaining the first set of LEDs and covering the LED region, and a second stem maintaining the second set of LEDs and covering the second LED region.

11. The LED light bulb device of claim 10, wherein the first light affecting feature is not visible from an exterior of the LED light bulb device.

12. The LED light bulb device of claim 1, wherein the first LED is characterized by the absence of a corrective coloring.

13. The LED light bulb device of claim 12, wherein the first LED is formed as part of a die-on-flex structure.

14. The LED light bulb device of claim 1, wherein the first LED is formed as part of a die-on-flex substrate and the first light affecting feature is a corrective coloring adhered to the flex substrate.

* * * * *